US008144010B2

(12) United States Patent
Smith et al.

(10) Patent No.: US 8,144,010 B2
(45) Date of Patent: Mar. 27, 2012

(54) GLASS-BREAK SHOCK SENSOR WITH VALIDATION

(75) Inventors: Richard A. Smith, El Dorado Hills, CA (US); Tom R. Petek, Sacramento, CA (US)

(73) Assignee: Honeywell International Inc., Morristown, NJ (US)

( * ) Notice: Subject to any disclaimer, the term of this patent is extended or adjusted under 35 U.S.C. 154(b) by 900 days.

(21) Appl. No.: 11/940,146

(22) Filed: Nov. 14, 2007

(65) Prior Publication Data

US 2010/0283607 A1 Nov. 11, 2010

(51) Int. Cl.

| | |
|---|---|
| ***G08B 19/00*** | (2006.01) |
| ***G08B 13/00*** | (2006.01) |
| ***G08B 13/08*** | (2006.01) |
| ***G08B 13/18*** | (2006.01) |

(52) U.S. Cl. ..... 340/541; 340/522; 340/545.4; 340/545.7; 340/545.8; 340/565; 340/567

(58) Field of Classification Search ..... 340/522, 340/541, 545.4, 545.7, 545.8, 565–567
See application file for complete search history.

(56) References Cited

U.S. PATENT DOCUMENTS

| | | | | |
|---|---|---|---|---|
| 4,882,567 | A * | 11/1989 | Johnson | 340/522 |
| 5,510,765 | A * | 4/1996 | Madau | 340/541 |
| 5,831,528 | A * | 11/1998 | Cecic et al. | 340/550 |
| 5,936,524 | A * | 8/1999 | Zhevelev et al. | 340/552 |
| 6,577,234 | B1 * | 6/2003 | Dohrmann | 340/540 |
| 6,762,686 | B1 * | 7/2004 | Tabe | 340/573.1 |
| 7,463,145 | B2 * | 12/2008 | Jentoft | 340/541 |
| 2006/0250236 | A1 * | 11/2006 | Ackley et al. | 340/540 |

* cited by examiner

*Primary Examiner* — Daniel Wu
*Assistant Examiner* — Kam Ma
(74) *Attorney, Agent, or Firm* — Husch Blackwell

(57) ABSTRACT

An intrusion detector for a security system that detects the breaking of a glass in a window or a door and motion within a protected area is provided. The intrusion detector includes a single sensing section, a first filter, a second filter, a microprocessor, and an alarm generating. The microprocessor includes a motion detection section, an activation section for activating the motion detection section for a preset period of time only when a detected acoustic signal is consistent with that required to break glass, and a timing section for timing the preset period. The sensing section is capable of sensing motion induced signals during both activation and non-activation of the motion detection section, but the motion detection section ignores motion-induced signals during non-activation of the motion detection section.

12 Claims, 4 Drawing Sheets

GLASS-BREAK SHOCK SENSOR WITH VALIDATION

BACKGROUND OF THE INVENTION

1. Field of the Invention

The present invention relates generally to sensors and security systems. More particularly, the present invention relates to a detector that includes a single sensing element adapted for detecting an impact to a glass and detecting an intrusion through a door or window.

2. Background

Sensors are used to detect events such as a glass break, motion, asset movement, temperature and impact/shock. These sensors can be used as a standalone device or in combination with a security system. A security system often includes a life safety and property protection system. The sensors communicate with a control panel when the sensor detects an event.

Existing prior art shock/impact sensors are prone to false alarms when the sensitivity is set high enough for detection. However, if the sensitivity is set low enough to reduce false alarms, then the sensors often fail to detect the event, i.e., glass break.

False alarms are a significant problem for security systems because the alarms result in a waste of resources. Specifically, a remote monitoring station receives the alarm from the control panel or sensor and will commence a response. This response can include calling the local police or fire department. The police or fire department will respond by traveling to the protected property and investigate the alarm. Meanwhile, a real alarm might be occurring at other locations.

Accordingly, there is a need for a sensor that can detect a glass break or an intrusion without having false alarms.

SUMMARY OF THE INVENTION

The present invention provides an intrusion detector that detects a glass break and motion within an area. The intrusion detector includes a single sensing element capable of detecting both glass break and human motion. Glass break is detected in the form of an acoustic signal. Human motion is detected in the form of a motion induced signal.

The intrusion detector also comprises a lens that focuses signals onto the single sensing element. Additionally, the intrusion detector comprises a first filter for filtering out a portion of the motion induced signal which is not in a preset frequency band and a second filter for attenuating a portion of the acoustic signal outside a second preset frequency band. The microprocessor determines whether signals detected by the sensing element are consistent with a mechanical impact required to break glass and indicative of human motion. The intrusion detector includes an alarm generating section for generating an alarm based upon the determination of the microprocessor.

The single sensing section comprises a pyro-electric sensor. The single sensing section changes electrical properties based upon the detected motion induced signal and acoustic signal. The motion-induced signal can be an infrared signal.

The lens confines the detection of the motion-induced signal to an area proximate to the window or door. The area covers an interior surface of the window or door.

The microprocessor comprises an activation section for activating a motion detection section for a preset period of time, and timing section for timing the preset period of time. The motion processing section ignores the motion-induced signal when the motion detection signal is not activated, e.g., when the preset period of time expires.

An alarm is only generated if the acoustic signal is indicative of an impact and the activated motion detection section determines that the motion-induced signal is indicative of motion. The intrusion detector also comprises a transmitter for transmitting a signal to a security system control panel when the alarm is generated. The signal can be a wireless signal.

Also disclosed is a method for detecting intrusion in protected premises. The method comprises detecting a first change in electrical properties of a sensing element, determining a cause of the first change in the electrical properties, activating a motion processing section if the cause of the first change is a physical impact is consistent with that required to break glass, setting a preset detection time for the activation of the motion processing section, determining if a second change in electrical properties is detected within the preset detection time, and determining if the second change in electrical properties is indicative of motion if the second change is within the preset detection time and generating an alarm only if it is determined that the first change is caused by a physical impact is consistent with that required to break glass and the second change is caused by motion within the protected area within the preset detection time.

The method further comprises the steps of determining if the second change in electrical properties is indicative of an impact and resetting a timer to the preset detection time based on the determination.

The second change in electrical properties is not processed for motion if the second change in electrical properties is not within the preset detection time.

An alarm signal can be transmitted to a control panel.

The cause of the change in the electrical properties is determined by amplifying the change in the electrical properties filtering the change in the electrical properties to generate a filtered signal and analyzing a rate of change and amplitude of the filtered signal. The rate of change and amplitude is compared with preset thresholds stored in memory.

BRIEF DESCRIPTION OF THE DRAWINGS

These and other features, benefits and advantages of the present invention will become apparent by reference to the following text and figures, with like reference numbers referring to like structures across the view, wherein.

DETAILED DESCRIPTION OF THE INVENTION

Figure 1:
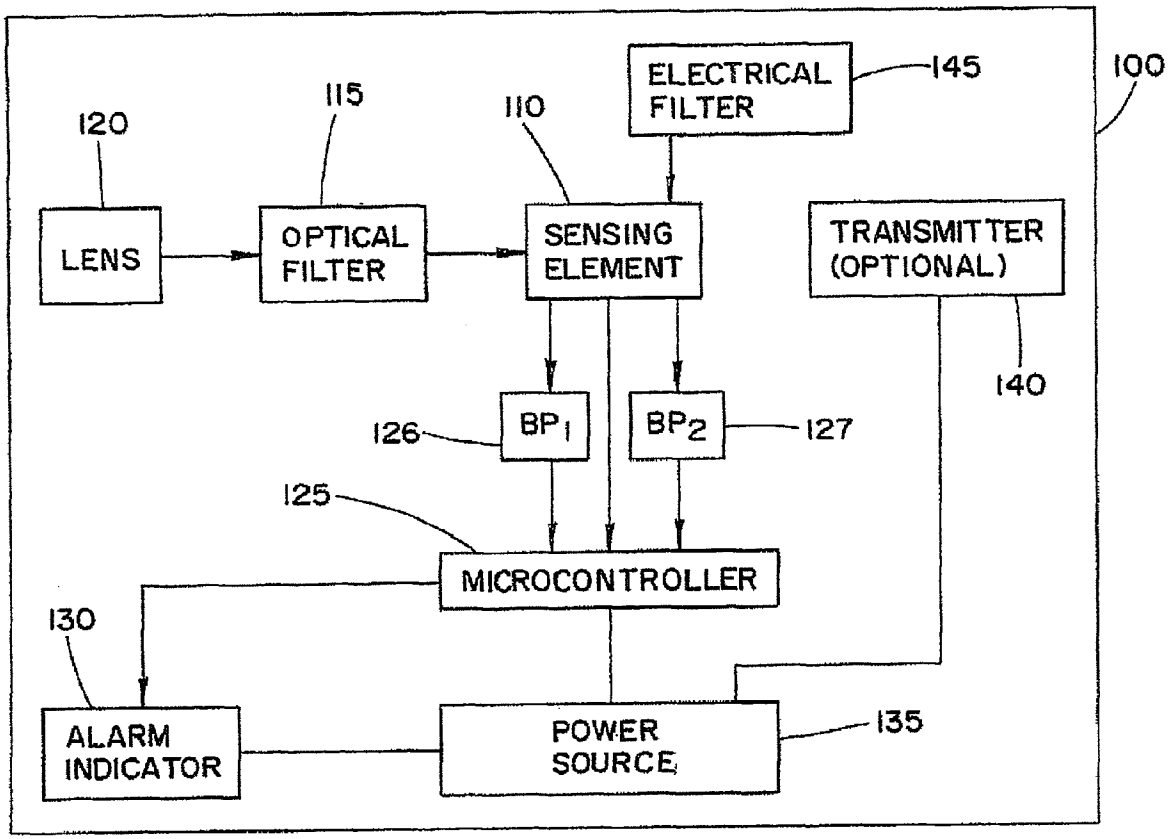
FIG. 1 is a block diagram of the intrusion detector in accordance with the invention.

FIG. 1 illustrates a block diagram of the intrusion detector 100. The intrusion detector 100 includes a sensing element 110, an optical filter 115, a lens 120, a microcontroller 125, two band-pass filters (BP) 126 and 127, an alarm indicator 130 and a power source 135. Additionally, the intrusion detector 100 will include an electrical filter 145. Optionally, the intrusion detector 100 can include a transmitter 140. In an embodiment, a Far Infrared (FIR) filter can be used as the optical filter.

The intrusion detector 100 can be a passive infrared detector (PIR). A PIR measures infrared light radiating from objects in a field of view. Motion is detected when an infrared emitting source with one temperature, such as a human body and passes in front of a source with another temperature. Motion is detected based on the difference in temperature. The speed of the motion can be detected as a function of the frequencies of the signals received by the sensing element 110. Other types of motion detectors, which are also shock sensitive can be used.

The sensing element 110 is constructed from a solid-state sensor. More than one solid-state sensor can be used for the sensing element 110. In the preferred embodiment, a material that has both pyro-electric and piezo-electric properties is used. A pyro-electric material is capable of generating an electrical potential when it is heated or cooled. A piezo-electric material is capable of generating an electric potential in response to applied mechanical shock or impact. For example, the sensing element can be constructed from Lithium tantalate ($LiTaO_3$) which is a crystal exhibiting both piezo-electric and pyro-electric properties. However, other materials can be used. Lithium tantalate is presented only as an example and is not an exhaustive list of all of the materials. The sensing element 110 is located within a housing of the intrusion detector 100.

The voltage that is produced by the sensing element 110 is very small and, therefore, the voltage is amplified. The gain of the amplifier is variable and can be controlled to vary the sensitivity of the intrusion detector. For example, a gain can be set at 10000.

A lens 120 is placed in front of the sensing element 110 to focus the infrared energy onto the sensing element 110. For example, intrusion detector 100 can have a Fresnel lens molded externally. The infrared energy or signal will enter the housing of the intrusion detector only through the lens 120.

Additionally, in an embodiment, the lens 120 is adapted to filter the infrared signal. The filter will ideally pass a signal in the range of 750 nm to 1 mm in wavelength, consistent with the "black-body radiation" given off by humans.

In another embodiment, a separate optical filter 115 (as illustrated in FIG. 1) is placed over the sensing element 110. The optical filter 115 functions in the same manner as a lens having additional filtering capability.

Figure 2:
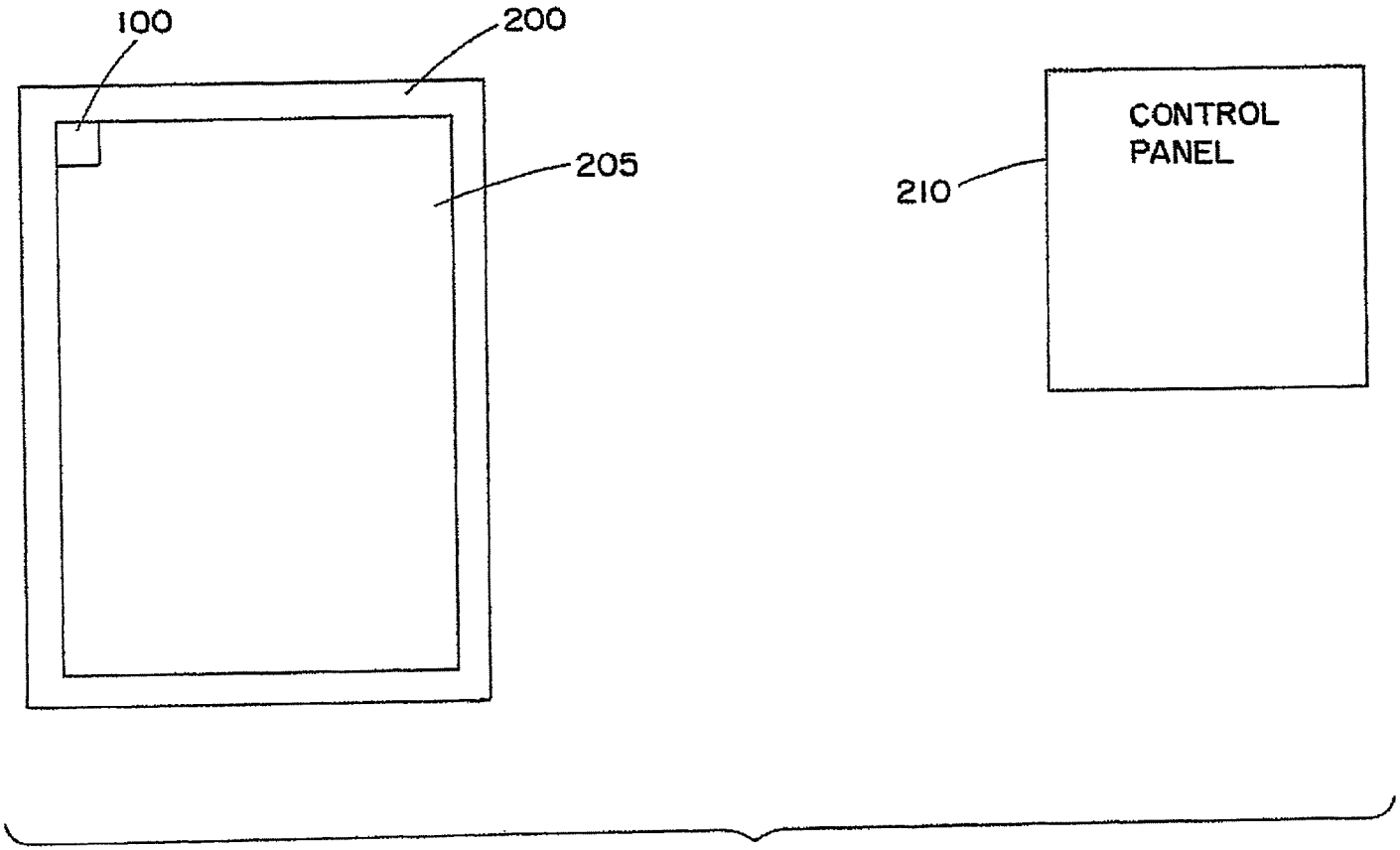
FIG. 2 illustrates an exemplary intrusion detector in combination with a security system in accordance with an embodiment of the invention.

The sensing element 110 is positioned within the intrusion detector 100 in a location such that the sensing element 110 is also capable of sensing an impact to a glass panel 205 of a window or door (as illustrated in FIG. 2).

The intrusion detector 100 includes an electrical filter 145 adapted to filter out noise and other frequency components of acoustic signals that are not consistent with an impact to a glass panel 205. The electrical filter 145 can be configured to attenuate signals not in one or two specific frequency bands of interest. For example, the electrical filter 145 can allow frequencies between 500 Hz and 61(Hz. A second band that is allowed can be 6 KHz to 16 KHz. In another embodiment, the electrical filter 145 can be a high pass filter with a pole set somewhere between 20 Hz to 500 Hz.

The sensing element 110 will exhibit a change in electrical properties such as change in voltage, e.g., induced voltage when motion occurs or an impact occurs.

The microcontroller 125 is configured to determine the source of the change in electrical properties, e.g., motion or impact, and respond accordingly. The determination is based upon the rate of change, e.g., duration and amplitude of the induced voltage.

As stated above, the change in voltage is small and, therefore, the change is amplified. Additionally, a filtering occurs for the induced voltage. Two bandpass filters 126 and 127 are used to filter two different bands, one band representing a motion channel and the other band representing an impact channel. The microcontroller 125 receives as an input the amplified and filtered induced voltage. In another embodiment, bandpass filters 126 and 127 can be included in the microprocessor 125.

Figure 4:
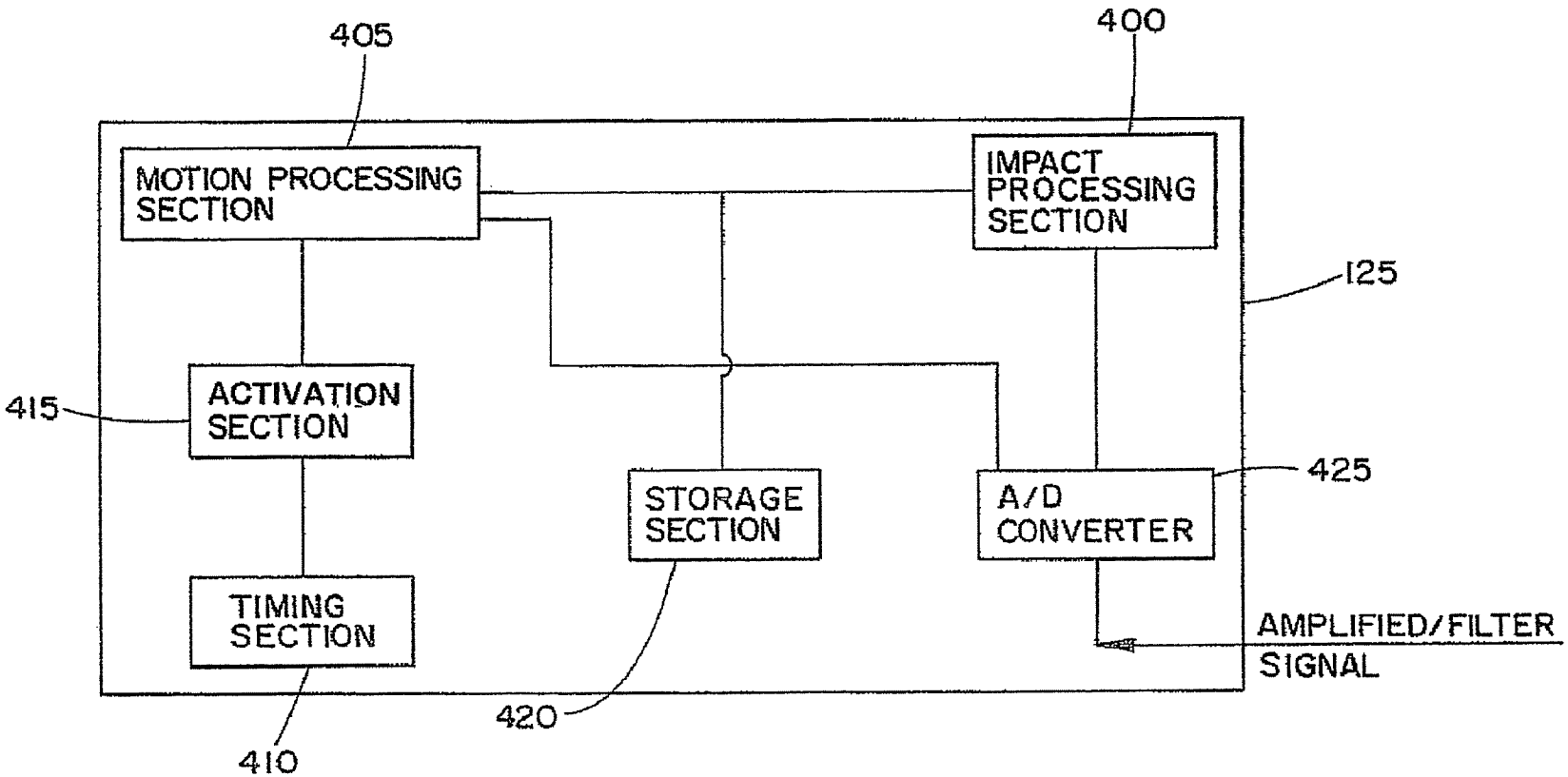
FIG. 4 illustrates a block diagram of the microcontroller in accordance with the invention.

FIG. 4 illustrates a block diagram of the microcontroller 125. The microcontroller 125 includes an impact processing section 400, a motion processing section 405, timing means 410, an activation section 415, a storage section 420, and an A/D converter 425. The amplified and filtered signal is converted to a digital signal by the A/D converter. The microcontroller 125 is programmed with firmware to execute the functionality of the intrusion detector 100. The storage section 420 includes all preset thresholds, such as rate of change and the detection thresholds for the determining whether an impact is indicative of glass break and whether the infrared signal is indicative of motion. Additionally, a time threshold is also stored in the storage section 420. The timing threshold is used to determine when to activate the motion processing section. The impact processing section 400 is always activated and processes the voltage change for characteristics indicative of an impact. The motion processing section 405 is only activated for a preset period of time after a determination of an impact to a glass panel 205. The motion processing section 405 is activated by the activation section 415. The preset period of time is determined by the timing section 410.

The storage section 420 can be any type of memory. The timing section 410 enables the microcontroller 125 to determine a timing difference between two consecutive electrical property changes.

As depicted in FIG. 1, the alarm indicator 130 outputs a signal indicative of an alarm condition. The alarm indicator 130 can be a light emitting diode (LED), a speaker or a relay. Additionally. A wireless transceiver or transmitter can be used to send a signal or code to a control panel. Additionally, a wired communication path, such as a system communication bus can be used to transmit a code.

The alarm indicator 130 can be located on the external surface of the housing. An LED or a speaker is positioned to be a visual or audible signal to a person within a protected premises to notify them of an alarm condition. An alarm is only generated if motion is detected within a preset period of time of a detection of an impact to a glass panel 205, where the impact causes the glass to break, i.e., acoustic signal indicative of glass-break.

FIG. 2 illustrates an example of a security system having at least one intrusion detector 100 according to an embodiment of the invention. The security system includes a control panel 210 in communication with the intrusion detector 100. As depicted, the intrusion detector 100 is mounted on a frame 200 of a window.

Figure 3:
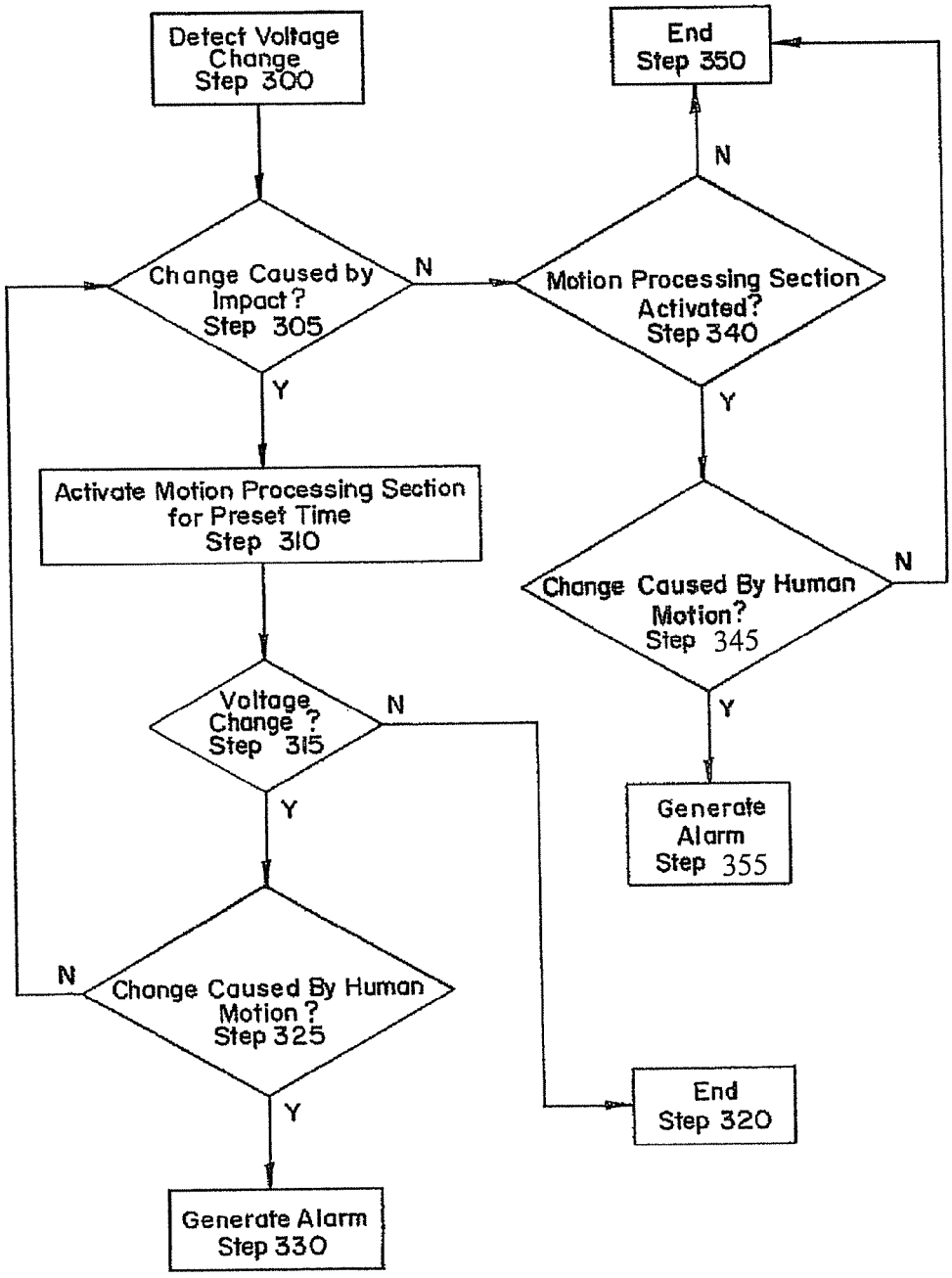
FIG. 3 illustrates a flow chart for the detection method in accordance with an embodiment of the invention.

FIG. 3 illustrates a flow chart for an intrusion detection method according to an embodiment of the invention.

At step 300, a voltage change in the sensing element 100 is detected. In an embodiment of the invention, the voltage change is measured at a source terminal of a source follower. In an embodiment, the source follower is an FET, and the voltage is measured at the source pin. The voltage is measured after gain or amplification. In an embodiment, the amplifier is a differential amplifier, using one or two stages of amplification. The voltage change is an analog voltage. This voltage is analog-to-digital converted by an A/D converter for processing by the microcontroller 125. In an embodiment, a separate A/D converter is used.

At step 305, the microcontroller 125 determines if the voltage change is caused by an impact by measuring, filtering and examining the voltage. The examination evaluates the amplitude, frequency, and duration of the measured voltage. The detected voltage change is filtered by BP1 126. A voltage change caused by an impact or shock has a different duration and frequency than a voltage change caused by motion. If the measured voltage is a higher frequency having a short duration, the change is caused by an impact and the process proceeds to step 310. Alternatively, if the change in voltage is a lower frequency having a longer duration, the change is caused by motion, and process proceeds to step 340.

At step 310, the activation section 415 activates the motion processing section 405, for a preset period of time. The motion processing section 405 is a portion of the microcontroller dedicated for processing the filtered and amplified voltage change for motion. The motion processing section 405 can be a comparison device that compares the characteristics of the detected voltage change with prestored thresholds, e.g., duration and amplitude. In other words, the sensing element 110 is always sensing signals. However, the voltage change is ignored and not processed or analyzed for motion at all times. The voltage change is only processed for motion during the preset period of time which the motion processing section 405 is activated. The preset period of time can be adjusted. The period of time should be long enough to prevent an intruder for waiting for a short period of time, after breaking the glass to enter the premises. However, the period of time should be short enough to detect a motion that results from an intruder entering the premise after breaking the glass. In an embodiment, the preset period of time is randomly set. The microcontroller 125 sets a timing section 410 to the preset period of time using a time period stored in the storage section 420. After the preset period of time expires, the activation section 415 deactivates the motion processing section 405.

The microcontroller 125 waits for any voltage change induced in the sensing element 110, during this preset period of time, at step 315. If no voltage change occurs within the preset period of time, the process ends at step 320, i.e., no motion is detected within the preset period of time.

If there is a voltage change induced in the sensing element 110, during this preset period of time, the microcontroller 125 determines the cause of the change, at step 325, e.g., impact processing section 400 and motion processing section 405. Specifically, the motion processing section 405 determines if the voltage change was caused by motion within the protected area by measuring, filtering, and examining the voltage. The examination evaluates the amplitude, frequency and duration of the detected voltage. The determination process is the same as described above and will not be described again.

If the voltage change is not caused by motion, the process returns to step 305. Alternatively, if the voltage change is caused by motion, and the amplitude is greater than a predetermined threshold, the microcontroller 125 outputs an enabling signal to alarm indicator 130, at step 330. The alarm indicator 130 will generate an alarm.

If at step 305, the detected voltage change is not caused by an impact or shock, the microcontroller 125 determines if the motion processing section 405 is activated, at step 340. If the motion processing section 405 is not activated, the voltage change is ignored, and the process ends, at step 350.

If the motion processing section 405 is activated (a prior impact was already detected), the motion processing section 405 determines if the detected voltage change is indicative of human motion using the same procedure as described above, at step 345. If the voltage change is caused by motion, and the amplitude is greater than a predetermined threshold, the microcontroller 125 outputs an enabling signal to alarm indicator 130, at step 355. The alarm indicator 130 will generate an alarm. If the detected voltage change is not indicative of motion or if the amplitude is not greater than a detection threshold, then the process ends, at step 350.

The invention has been described herein with reference to a particular exemplary embodiment. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. An intrusion detector for a security system that detects the breaking of a glass in a window or a door and motion within a protected area comprising:

a single sensing section for detecting mechanical impact in a form of an acoustic signal on the window or glass and for detecting motion in a form of a motion induced signal within a protected area;

a lens for focusing the motion induced signal;

a first filter for filtering out a portion of the motion-induced signal which is not in a preset frequency band;

a second filter for attenuating a portion of the acoustic signal outside a second preset frequency band;

a microprocessor for determining if the detected acoustic signal is consistent with that required to break glass and if the detected motion induced signal is indicative of motion with the protected area; and an alarm generating section for generating an alarm based upon the determination of the microprocessor, wherein the single sensing section is capable of detecting a first change in electrical properties, wherein the microprocessor is capable of determining a cause of the first change in the electrical properties, activating a motion processing section only when the cause of the first change is a physical impact that is consistent with that required to break glass, and setting a preset detection time for said motion detection, wherein the microprocessor is capable of determining if a second change in electrical properties is detected within the preset detection time, wherein the microprocessor is capable of determining if the second change in electrical properties is indicative of motion if the second change is within the preset detection time, and determining if the second change in electrical properties is indicative of a physical impact that is consistent with that required to break glass if the second change is within the preset detection time, wherein, when it is determined that the first change is caused by a physical impact that is consistent with that required to break glass and the second change is caused by motion within the protected area within the preset detection time, the alarm generating section is capable of generating the alarm, wherein, when it is determined that the first change is caused by a physical impact that is consistent with that required to break glass and the second change is caused by a physical impact that is consistent with that required to break glass, the microprocessor is capable of resetting a timer to the preset detection time, wherein the microprocessor is capable of deactivating the motion processing section after expiration of the preset detection time, and ignoring said second change in electrical properties after the expiration of the preset detection time, and wherein said second change in electrical properties is received from the single sensing section within and outside of the preset detection time, but said second change in electrical properties is not processed for motion if the second change in electrical properties is not within the preset detection time.

2. The intrusion detector of claim 1, wherein said single sensing section comprising a pyre-electric sensor.

3. The intrusion detector of claim 1, wherein said lens confines the detection of the motion induced signal to an area proximate to the window or door.

4. The intrusion detector of claim 3, wherein said area covers an interior surface of the window or door.

5. The intrusion detector of claim 1, wherein said single sensing section changes electrical properties based upon the detected motion induced signal and acoustic signal.

6. The intrusion detector of claim 1, wherein said alarm is only generated if the acoustic signal is indicative of an impact and the activated motion detection section determines that the motion induced signal is indicative of motion.

7. The intrusion detector of claim 1, further comprising a transmitter for transmitting a signal to a security system control panel when said alarm is generated.

8. The intrusion detector of claim 7, wherein said signal is a wireless signal.

9. The intrusion detector of claim 5, wherein the motion induced signal is an infrared signal.

10. A method for detecting intrusion in a protected premises comprising the steps of:

detecting a first change in electrical properties of a sensing element;

determining a cause of the first change in the electrical properties;

activating a motion processing section only when the cause of the first change is a physical impact that is consistent with that required to break glass;

setting a preset detection time for said motion detection;

determining if a second change in electrical properties of the sensing element is detected within the preset detection time;

determining if the second change in electrical properties is indicative of motion if the second change is within the preset detection time;

determining if the second change in electrical properties is indicative of a physical impact that is consistent with that required to break glass if the second change is within the preset detection time;

when it is determined that the first change is caused by a physical impact that is consistent with that required to break glass and the second change is caused by motion within the protected area within the preset detection time, generating an alarm;

when it is determined that the first change is caused by a physical impact that is consistent with that required to break glass and the second change is caused by a physical impact that is consistent with that required to break glass, resetting a timer to the preset detection time;

deactivating the motion processing section after expiration of the preset detection time; and ignoring said second change in electrical properties after the expiration of the preset detection time, wherein said second change in electrical properties is received from the sensing element within and outside of the preset detection time, but said second change in electrical properties is not processed for motion if the second change in electrical properties is not within the preset detection time.

11. The method for detecting intrusion according to claim 10, further comprising the step of transmitting a signal to a control panel.

12. The method for detecting intrusion according to claim 10, wherein said step of determining a cause of first change in the electrical properties includes the sub-steps of:

amplifying the first change in the electrical properties;

filtering the first change in the electrical properties to generated a filtered signal; and determining the filtered signal based upon a rate of change and amplitude.

* * * * *